United States Patent [19]

Hanser et al.

[11] Patent Number: 4,655,269

[45] Date of Patent: Apr. 7, 1987

[54] PORTABLE LOG SPLITTER

[75] Inventors: Paul E. Hanser; Leroy A. Van Roekel, both of Wilton, Iowa

[73] Assignee: HWH Corporation, Moscow, Iowa

[21] Appl. No.: 825,027

[22] Filed: Jan. 31, 1986

[51] Int. Cl.[4] ..... B27L 7/00

[52] U.S. Cl. ..... 144/193 A; 144/366; 280/43.23; 280/764.1

[58] Field of Search ..... 144/193 A, 193 R, 366; 280/43.23, 43.24, 764.1

[56] References Cited

U.S. PATENT DOCUMENTS

| | | | |
|---|---|---|---|
| 3,162,459 | 12/1964 | Marmorine | 280/43.23 |
| 4,504,076 | 3/1985 | Bedney | 280/43.23 |
| 4,536,009 | 8/1985 | Ashworth | 280/764.1 |

*Primary Examiner*—W. D. Bray

*Attorney, Agent, or Firm*—Henderson & Sturm

[57] ABSTRACT

A portable log splitter having a frame supported adjacent to its rear and front ends by cranked axle structure and a stand interconnected with the axle for raising and lowering of the rear and front ends in unison and in a substantially level mode so as to enable the splitter device to more readily handle ground-supported logs. The splitter is rockable about a fore-and-aft axis through a range including an upright position and a generally horizontal position so as to achieve splitting in planes within that range. Raising and lowering of the frame increases the ability of the splitter to make horizontal splits at relatively low levels. The stand is disconnectible from the axle means for retraction clear of the ground to condition the frame for towing behind a towing vehicle.

7 Claims, 7 Drawing Figures

Fig. 6
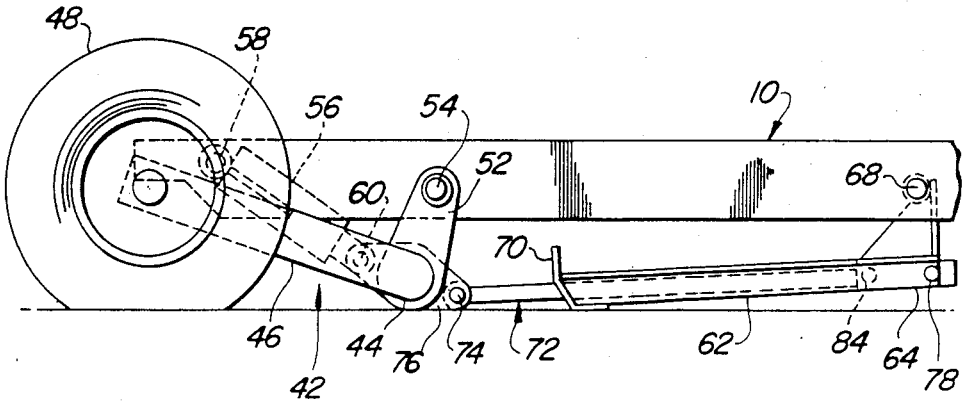
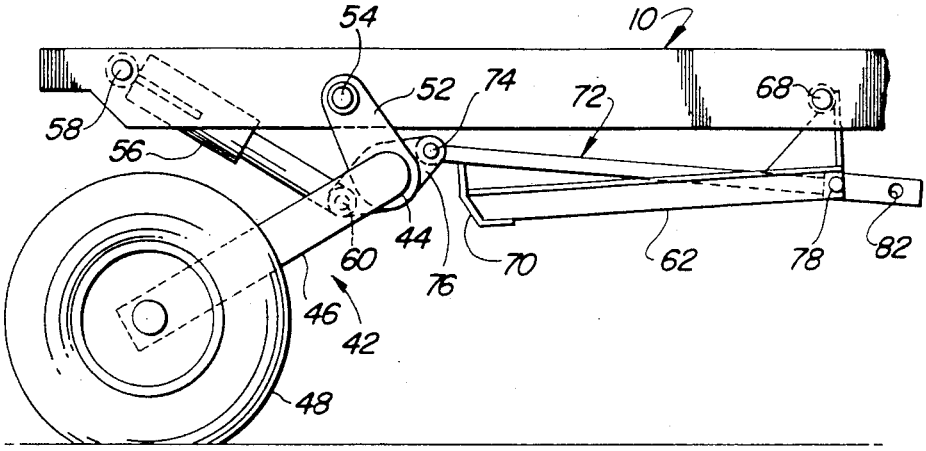
Fig. 7

PORTABLE LOG SPLITTER

BACKGROUND AND SUMMARY OF THE INVENTION

The invention relates to a portable log-handling machine that has a frame connectible at its front end to a towing vehicle and fitted at its rear end with a log splitter, especially of the type capable of handling logs lying on the ground, such as exemplified in assignee's prior U.S. Pat. No. 4,380,258. The present invention features front and rear ground-engaging means for the frame and which are operable in unison so as to raise and lower both ends of the frame in a substantially level attitude, thus enabling the splitter to adapt to logs of varying diameters and also to condition the splitter to operate at relatively low splitting planes because of the ability of the splitter to swing about a fore-and-aft axis through a range including an upright position and a position in which the splitter blade operates in a horizontal plane.

A further feature of the invention is that the front support, which is here a stand, can be retracted clear of the ground when the splitter frame is in a transport mode; i.e., trailed behind a towing vehicle. Means is provided for releasably retaining the stand in the position clear of the ground. This means includes a releasable connection to link means between the stand and the rear, wheeled support means in which the geometry among the stand, wheel means and link means provides an interlock that substantially immobilizes the wheel means against lowering when the stand is retracted. In this respect, it is an object to utilize a single pin selectively insertable in either of two holes in the link means according to the mode in which the stand is disposed; that is, operative with the wheel means to change frame elevation or retracted for transport of the frame.

The foregoing and other features will become apparent as a preferred embodiment of the invention is disclosed in detail in the ensuing description and accompanying drawings.

DESCRIPTION OF THE INVENTION

FIG. 6 shows the structure of FIG. 4 in its maximum lowered position.

FIG. 7 shows the structure in FIG. 4 in its transport or towing mode, with the frame at maximum elevation and the stand fully retracted clear of the ground.

DETAILED DESCRIPTION OF A PREFERRED EMBODIMENT OF THE INVENTION

Figure 1:
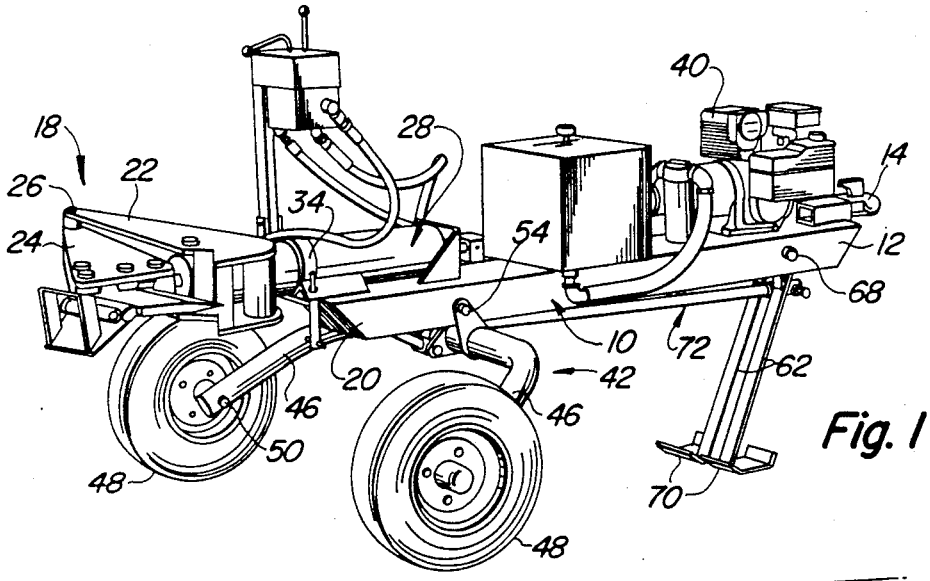
FIG. 1 is a perspective of the machine as seen from its rear and right-hand side while ground-supported and having its splitter turned to horizontal splitting mode.
Figure 2:
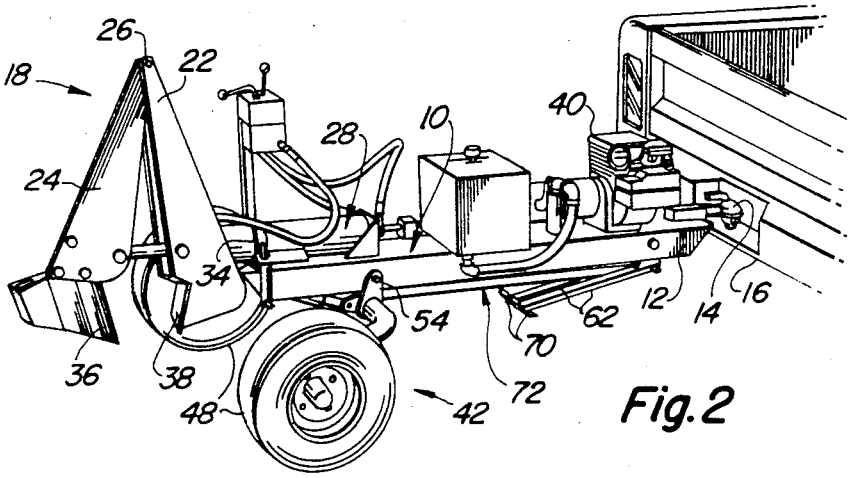
FIG. 2 is a perspective, on a reduced scale as compared with FIG. 1, showing the machine connected to a towing vehicle while its front leg is retracted and the splitter is in its upright position in which the splitter blade is disposed to split in a vertical plane.

Reference will be had first to FIGS. 1 and 2 for an over-view of the basic structure involved. The log-handling machine includes an elongated fore-and-aft frame

10 having a front end 12 provided with hitch means 14 for releasable connection to a towing vehicle 16. Although an entire vehicle is not shown, enough of its tow bar appears to represent the vehicle, which may be of any type, preferably an over-the-road vehicle for fast transport of the log-handling machine.

Figure 3:
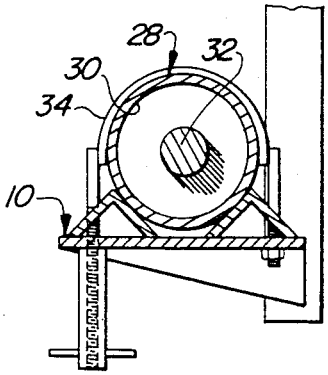
FIG. 3 is an enlarged section showing the splitter mounting to the frame for multi-positioning about a fore-and-aft axis.

A log splitter 18, preferably of the type forming the subject matter of the afore-mentioned U.S. patent, is carried at the rear end 20 of the frame. This splitter has a pivoted arm 22 carried by the frame, and a second arm 24 is pivoted to the free end of the first arm at 26 so that the arms may function tong or pincer fashion to receive a ground-supported log between them, as explained in the afore-mentioned patent. Opening and closing of the arms is achieved by power means, here a hydraulic motor 28 having a cylinder 30 and piston rod 32. The cylinder is mounted to the frame by a releasable band 34 (FIG. 3) and the "fixed" splitter arm 22 is carried by the cylinder, whereby the splitter may have the multi-positionability referred to above. The piston rod 32 is connected to the movable splitter arm 24, which is equipped with a splitter blade 36 for cooperation with an anvil on the fixed arm 22. An internal-combustion engine 40 powers a pump (not shown) as part of the hydraulic means for the motor 28, all of which details may be varied and as such form no part of the present invention.

When the splitter is to be used for splitting, it will be detached from the towing vehicle, because, since the machine handles logs lying on the ground, it must be capable of a certain amount of free movement as the logs are split. In its operative mode, the frame is supported at its front and rear by front and rear ground-engaging supports. The rear support is a cranked-axle means 42 having a bight 44 disposed transverse to the length of the elongated fore-and-aft frame 10. Right and left legs 46 are joined to the bight and extend lengthwise or alongside the frame and these legs journal wheels 48 via spindles 50, one of which will be seen in FIG. 1. The axle means is rockable on the frame about a transverse axis via ears 52 rigid with the bight and pivoted to the frame at 54. Clockwise rocking of the axle means about the pivot axis at 54 results in lowering of the frame and vice versa. Means for effecting such rocking is here shown as a hydraulic motor 56 connected between a frame anchor 58 and ears 60 rigidly secured to a mid-portion of the axle means bight 44. This motor may be powered by any suitable means (not shown).

The front support means comprising a stand having upper and lower ends 64 and 66, respectively, the former being pivoted to a front part of the frame on a transverse pivot at 68 and the latter including ground-engaging feet 70. As best seen from FIGS. 4 and 6, the stand may occupy two maximum positions, one of which is an extended or supporting position (FIG. 4) supporting the front of the frame at a maximum elevation while the axle and wheel means supports the rear part of the frame at approximately that elevation. Another position is that of full retraction, in which the axle and wheels means supports the rear part of the frame at or about minimum elevation and the stand is fully retracted so that the machine rests on the wheels, axle and retracted stand. An infinite number of operating positions between the maximum positions are available, as will appear below. A transport mode (FIG. 7) is also available in which the front of the frame will be supported on the towing vehicle and the wheels are extended to raise the rear of the frame. Also in this position, the stand is clear of the ground.

Figure 5:
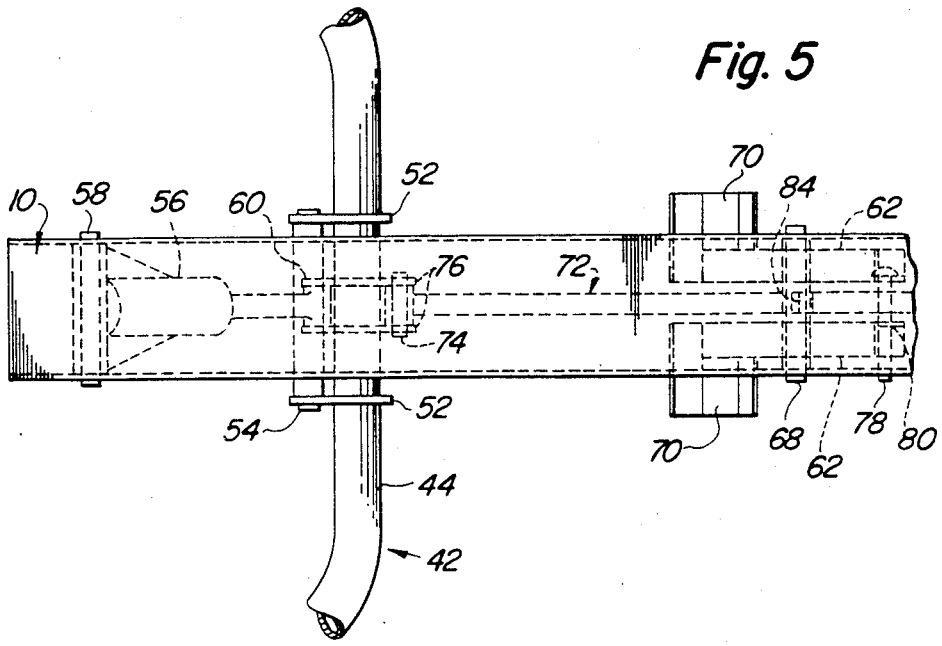
FIG. 5 is a plan of the structure shown in FIG. 4.

The interaction of the axle means and stand is achieved by the provision of a link means 72 having a rear end pivotally connected at 74 to a pair of ears 76 rigidly affixed to a mid-portion of the bight 44 of the axle means. The link means forms an interconnection between the stand and axle means, and the interconnection at the front end of the link means to the stand is multi-functional, including a bi-positional pin 78, a single hole 80 in the stand (FIG. 5) and front and rear holes 82 and 84, respectively, in a front part of the link means. In the operating modes involving swinging of the stand between its FIGS. 4 and 6 positions in unison with rocking of the wheel and axle means, the pin is used in the single hole 80 in the stand and the front hole 82 in the link means. These modes all occur when the splitter is detached from the towing vehicle.

Figure 4:
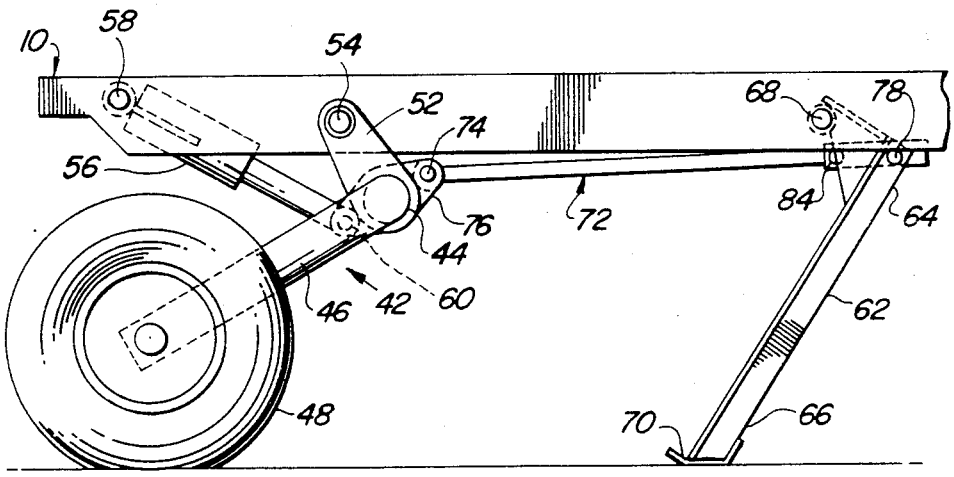
FIG. 4 is a side elevation, with parts omitted, showing the frame in its maximum elevated position and with the front stand down in supporting position.

FIG. 4 shows the frame raised and supported on its wheels and the stand 62. Observing that the splitter is detached from the towing vehicle, the lowering of the frame involves the following: The motor 56 is operated to retract its piston, swinging the arm 52 in a clockwise direction about the pivot 54. The bight 44 of the axle is rigid with the arm 52, as are the ears 76, meaning that the pivot 74 swings clockwise about the pivot 54, exerting a tensional force on the link means 72 which, being connected at 78–84 to the stand, swings the stand rearwardly about its pivot 68 to the frame. In this mode operation, the front hole 82 in the link means is not used. The maximum lowered position is shown in FIG. 6. To move out of this position and back to the FIG. 4 position, the axle motor is actuated to extend the piston, reversing the swinging movements referred to in moving from FIG. 4 to FIG. 6.

When the splitter is to be connected by its hitch to the towing vehicle, the axle means motor is activated to raise the frame and the pin 78 is removed from the holes 80 and 82 just referred to and is replaced in the hole 80 in the stand and the rear hole 84 in the link means. While the pin 78 is removed and the hitch connection made to the towing vehicle, the stand may be manually swung upwardly and rearwardly to its maximum up or retracted position (FIG. 7) in which its feet are clear of the ground. At this point, it should be observed that the machine is light enough to be "man-handled" while disconnected from the towing vehicle. When the pin 78 is re-inserted in the holes 80 and 84 of the stand and link means, respectively, it serves at the same time as means for retaining both the stand and the front end of the link meas in their up positions; that is, neither the stand nor the link can return to or toward the ground. Furthermore, in this mode, the axle cannot be rocked in a counterclockwise direction because the motor 56 is fully extended, nor can it be rocked to any appreciable extent in a clockise direction because of the geometry among the axle means, the link means and the retracted stand. Thus the axle means is substantially immobilized in this respect, which will be clear by noting that clockwise rocking of the axle means about the pivot at 54 means that the pivot 74 must move rearwardly, which it cannot because of the fixed length of the link means 72; i.e., the link means is stressed in tension between points 74 and 78 (in the rear hole 84 in the link), and the lever arm between points 68 and 78 is too short, besides which the feet 70 would ultimately stop against the bottom of the frame 10. Thus, should the motor 56 be inadvertently activated or should it leak down, the elevated status of the splitter frame while in transport mode will be retained.

I claim:

1. In a log-handling machine having an elongated, fore-and-aft frame including front and rear ends, hitch means at the frame front end for releasable connection of the frame to a towing vehicle and log splitter means carried at the frame rear end, the improvement comprising a cranked axle structure adjacent to the frame rear end and including a bight transverse to the frame, right and left arms joined to the bight and extending lengthwise of the frame and right and left ground-engaging wheels journaled respectively on the legs, means mounting the bight on the frame for rocking about a transverse axis for means for rocking the cranked means, raising and lowering the frame rear end, a stand at the frame front end and having an upper end and a ground-engageable lower end for supporting the front end of the frame when the frame is disconnected from the towing vehicle, means mounting the stand at its upper end to the frame front end for selective swinging about a transverse axis, and link means extending between the cranked axle means and the stand and having front and rear ends connected respectively between the stand and the axle means for swinging the stand and rocking the axle means in unison so as to effect raising and lowering of the frame front and rear ends in a substantially level attitude.

2. In a log-handling machine according to claim 1, in which one of the ends of the link means is disconnectible to enable retraction of the stand to a position clear of the ground when the frame is connected to a towing vehicle.

3. In a log-handling machine according to claim 2, including means for releasably retaining the stand in said position clear of the ground.

4. In a log-handling machine according to claim 1, in which the front end of the link means is disconnectible from the stand to enable swinging of the stand independently of the link means to a position clear of the ground when the hitch means is connected to a towing vehicle.

5. In a log-handling machine according to claim 4, including means releasably retaining the stand in said position and for releasably retaining the front end of link means in a position also clear of the ground.

6. In a log-handling machine according to claim 5, in which said means for retaining the stand and the front end of the link means comprises a pair of fore-and-aft spaced apart holes in the front end of the link means, a hole in the stand, and pin passed through the hole in the stand and the forward hole in the link means during raising and lowering of the stand and axle means, and said pin being removable and insertable through the hole in the stand and the rear hole in the link means to retain the stand and link means in their positions clear of the ground.

7. In a log-handling machine according to claim 6, in which the geometry involved among the axle means, the link means, the retracted stand and the pin in the rear hole of the link means provides and interlock that substantially immobilizes the axle means against rocking.

* * * * *